US008496721B2

(12) United States Patent
Meusel et al.

(10) Patent No.: US 8,496,721 B2
(45) Date of Patent: Jul. 30, 2013

(54) HOLLOW BODY HAVING AN INTEGRATED OIL SEPARATING DEVICE

(75) Inventors: Juergen Meusel, Dittmannsdorf (DE); Ulf Mueller, Chemnitz (DE); Andreas Stapelmann, Oberhausen (DE); Daniel Paul, Burkhardtsdorf (DE)

(73) Assignee: ThyssenKrupp Presta TecCenter AG, Eschen (LI)

( * ) Notice: Subject to any disclaimer, the term of this patent is extended or adjusted under 35 U.S.C. 154(b) by 0 days.

(21) Appl. No.: 13/255,795

(22) PCT Filed: Jan. 16, 2010

(86) PCT No.: PCT/EP2010/000231

§ 371 (c)(1),
(2), (4) Date: Oct. 11, 2011

(87) PCT Pub. No.: WO2010/102689

PCT Pub. Date: Sep. 16, 2010

(65) Prior Publication Data

US 2012/0023876 A1 Feb. 2, 2012

(30) Foreign Application Priority Data

Mar. 10, 2009 (DE) ..... 10 2009 012 401

(51) Int. Cl.
*B04C 3/00* (2006.01)

(52) U.S. Cl.
USPC ..... 55/457; 55/400; 55/413; 55/447; 55/456; 55/459.1; 96/400

(58) Field of Classification Search
USPC .... 55/400, 413, 447, 456, 457, 459.1; 96/400
See application file for complete search history.

(56) References Cited

U.S. PATENT DOCUMENTS

| | | | | |
|---|---|---|---|---|
| 4,329,968 | A | 5/1982 | Ishikawa et al. | |
| 4,651,704 | A | 3/1987 | Sekiguchi | |
| 7,717,101 | B2 | 5/2010 | Beetz et al. | |
| 2007/0294986 | A1 * | 12/2007 | Beetz et al. | 55/385.3 |

FOREIGN PATENT DOCUMENTS

| | | | |
|---|---|---|---|
| DE | 10 2004 008 826 | A1 | 9/2005 |
| DE | 10 2004 011 177 | A1 | 10/2005 |
| DE | 10 2005 034 273 | A1 | 6/2006 |
| DE | 10 2005 022 254 | A1 | 11/2006 |
| WO | WO 2006/119737 | A1 | 11/2006 |

OTHER PUBLICATIONS

Corresponding International Search Report with English Translation dated May 17, 2010 (six (6) pages).
VDI-report (VDI-Reports No. 2042, 2008, pp. 152-153, Chapter 4 and Figure 6.

* cited by examiner

*Primary Examiner* — Jason M Greene
*Assistant Examiner* — Dung H Bui
(74) *Attorney, Agent, or Firm* — Crowell & Moring LLP

(57) ABSTRACT

A hollow body includes an integrated oil separator unit, a swirl generator located in a cavity of the hollow body, at least one first supply opening in the camshaft case for introducing gas that is charged with oil into the cavity, and at least one discharge opening for carrying away separated oil and for carrying away gas that has been cleaned of oil. The swirl generator also has elements that are used to variably influence the pressure prevailing at a predetermined point in the cavity.

19 Claims, 2 Drawing Sheets

HOLLOW BODY HAVING AN INTEGRATED OIL SEPARATING DEVICE

BACKGROUND AND SUMMARY OF THE INVENTION

The present invention relates to a body which is formed at least in regions in a hollow-cylindrical manner, is designated hereinafter as a hollow body, and has an integrated oil separating device. Preferably, the hollow body is formed by means of a camshaft.

International PCT publication WO 2006/119737 A1 discloses a hollow shaft having an integrated oil separating device, wherein in addition to a pre-separator, which is disposed on the outer periphery of the shaft, there is provided a swirl generator, which is integrated into the cavity of the shaft, as a final separator.

Furthermore, a camshaft having integrated oil separation is disclosed in a VDI-report "*Nockenwelle mit integrieter Ölabscheideeinrichtung NÖA*" [camshaft with an integrated oil separating device] (VDI-Reports no. 2042, 2008, page 152, Chapter 4 and FIG. 6), wherein a helical swirl generator is disposed in the cavity of the camshaft.

It is the object of the present invention to provide a generic hollow body having an integrated oil separating device which, even in the case of critical pressure ratios in the environment of the oil separating device, ensures a secure mode of operation thereof. In particular, a predetermined level of efficiency of the oil separation at different pressure ratios is to be ensured.

In accordance with the invention, this object is achieved by features claimed, with further expedient developments of the invention defined in the subordinate claims.

In accordance with the present invention, the swirl generator which is disposed in the interior of the hollow body comprises means for variably influencing the pressure prevailing in the cavity of the hollow body at a predetermined location. In an advantageous manner, these means are formed such that in the case of a pressure which occurs at the predetermined location and which is greater than or equal to a predetermined desired pressure, an automatic reduction of the actual pressure is effected at this location. In a first possible embodiment of the invention, the swirl generator which is integrated in the hollow body is of any design and is characterised by virtue of the fact that over its entire longitudinal extension it comprises an axial bypass channel, into which a pressure-dependent bypass valve is integrated. At least regions of the swirl generator are formed in such a manner that the swirl generator divides the cavity of the hollow body into two pressure regions which are separated or can be separated from each other in terms of pressure technology, wherein in the pressure region which is located downstream as seen in the flow direction, gas which is charged with oil can be introduced via the first supply opening into the cavity and gas which is likewise charged with oil can be supplied via a pressure region, which is located upstream as seen in the flow direction, via a second supply opening. The first supply opening as seen in the flow direction is disposed downstream of the pressure-separating part of the swirl generator and the second supply opening as seen in the flow direction is disposed upstream of the separating part of the swirl generator. In an advantageous manner, the bypass value which is integrated in the bypass channel is formed as a spring-loaded non-return valve such that when the predetermined pressure in the cavity of the hollow body is reached or exceeded the bypass valve opens and the bypass channel is released, so that the two pressure regions are connected together in terms of pressure and flow technology— they are connected together at least as long as the pressure in the cavity is greater than or equal to the predetermined pressure.

In a further embodiment, the means for variably influencing the pressure prevailing in the cavity are formed alternatively or additionally by virtue of the fact that the swirl generator is formed as a body which extends in the axial direction of the hollow body and which comprises on its periphery at least one screw channel. At least regions of the at least one screw channel are mounted in an axially displaceable manner on or at the basic body of the swirl generator—likewise in such a manner that when the predetermined pressure in the cavity of the hollow body is reached or exceeded the screw channel or screw channel portion is displaced in the flow direction in particular against a restoring force.

The invention will be described in greater detail hereinafter with the aid of various exemplified embodiments.

DETAILED DESCRIPTION OF THE INVENTION

Figure 1:
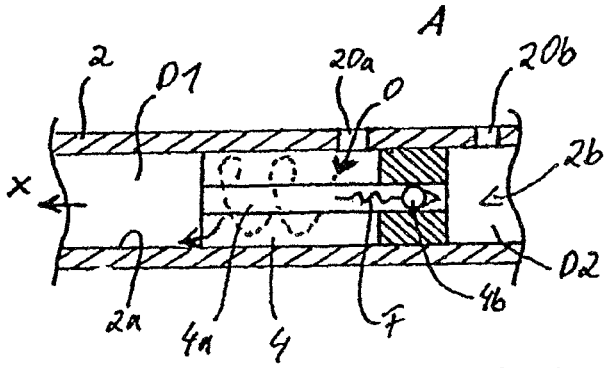
FIG. 1 shows a schematic illustration of sections of the inventive hollow body having an integrated swirl generator with an integrated bypass channel and non-return valve.

FIG. 1 illustrates sections of a hollow body 2 which is formed e.g. as a camshaft and has an integrated swirl generator 4. The swirl generator 4 is of any design and comprises along its longitudinal extension as seen in the flow direction X a continuous bypass channel 4*a*, into which a bypass valve 4*b* is integrated. The swirl generator 4 serves to divide the cavity 2*b* of the camshaft 2 into two pressure regions D1 and D2 which are separated from each other in terms of pressure technology (or can be separated and then connected via the bypass valve 4*b* which is formed as a spring-loaded non-return valve). As seen in the flow direction X, the first pressure region D1 is located downstream of the swirl generator 4, whereas the second pressure region D2 is located upstream of the swirl generator 4. The part of the cavity 2*b* which is allocated to the first pressure region D1 is connected via a first supply opening 20*a* to the outer region A of the camshaft 2, so that as a result the blow-by-gas which is to be cleaned can flow into the cavity 2*b* of the hollow body 2. In the part of the cavity 2*b* which is allocated to the second pressure region D2, a second supply opening 20*b* is provided, via which gas (blow-by-gas) which is charged with oil can be supplied likewise from the outer region A of the camshaft 2 to the cavity 2*b* in the pressure region D2. If a predetermined pressure is then reached in the cavity 2*b*, the two pressure chambers D1 and D2 are connected together via the bypass valve 4*b*, so that a desired pressure equalisation can take place and therefore a desired pressure is maintained. For example, the negative pressure prevailing in the first pressure region D1 located downstream of the swirl generator 4 or else the pressure region D2 located upstream of the swirl generator 4 can be monitored, as the pressure which is to be monitored, with regard to a corresponding overpressure. The bypass valve 4*b* can be formed e.g. as a non-return valve which is influenced by a restoring force in the direction opposite the flow direction X.

Figure 2:
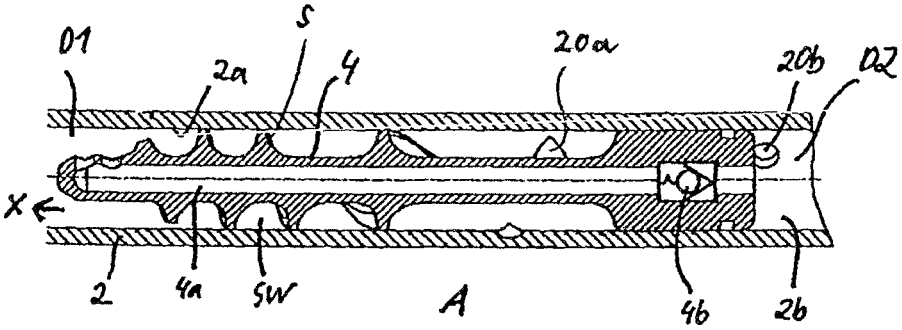
FIG. 2 shows a schematic illustration of the inventive hollow body having an integrated, helically formed swirl generator and an integrated bypass channel and bypass valve.

FIG. 2 illustrates a hollow body 2 which is formed as a camshaft and has an integrated swirl generator 4 as shown in FIG. 1 in one embodiment in which the swirl generator 4 is formed as a body which extends in the axial direction of the hollow body 2 and has at least one circumferentially disposed screw channel S. The axial body of the swirl generator 4 has a bypass channel 4*a* passing through it which comprises a non-return valve or bypass valve 4*b* on its side located upstream as seen in the flow direction X. The bypass channel 4*a* issues in the end region of the swirl generator 4 into the cavity 2*b* of the hollow body 2, preferably at an angle between 0° and 110° with respect to the axis of the swirl generator 4, in particular at an angle in the region of 90°. The bypass valve 4*b* is connected to the outer region A of the camshaft 2 via supply openings 20*b* located upstream as seen in the flow direction X and is influenced by the pressure of the blow-by-gas. If a pump, not illustrated, which as seen in the flow direction X is coupled downstream to the camshaft 2 performs excessively strong suction or if the pressure of the blow-by-gas is too great in the outer region A of the camshaft 2, the bypass valve 4*b* opens and releases the bypass channel 4*a* for the blow-by-gas. In this manner, the pressure drop above the swirl generator 4 can be kept virtually constant in a manner dependent upon the volume flow and the swirl generator 4 can be operated at a predetermined level of efficiency. The supply openings 20*a* and 20*b* for supplying the blow-by-gas into the cavity 2*b* of the hollow body 2 are designed advantageously in the form of tangential bores. In terms of the invention, the phrase "tangentially extending bores in the camshaft wall" is understood to be those bores in which a bore wall enters into the cavity 2*b* of the hollow body 2 in a continuous manner.

Figure 3:
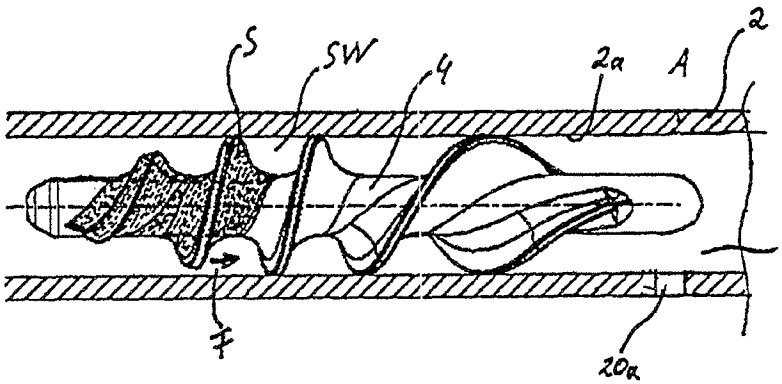
FIG. 3 shows a schematic illustration of sections of the inventive hollow body having a helically formed swirl generator and a screw channel portion which is mounted so as to be displaceable in the axial direction.

FIG. 3 illustrates a further possible embodiment of the hollow body 2 in accordance with the invention, in which the swirl generator 4 comprises means for variably influencing the pressure prevailing in the cavity 2*b* at a predetermined location which are formed by virtue of the fact that the swirl generator 4 is formed as a body which extends in the axial direction of the hollow body 2 and which comprises on its periphery at least one screw channel S, wherein at least regions or portions of the at least one screw channel S (screw channel (portion) S') are mounted in such a manner as to be axially displaceable on the basic body of the swirl generator 4 and the displaceable screw channel portion or screw channel S' is influenced by means of a restoring force F in the direction opposite the flow direction X. In this embodiment of the helical swirl generator 4, at least one screw channel S or screw channel portion S' is displaceable relative to another screw channel S or screw channel portion, so that the cross-section of the helical flow path SW formed by the screw channel S can be actively changed or adjusted. This type of active adjustment can be effected e.g. by the gas flow of the blow-by-gas itself. For this purpose, the screw channel (portion) S' is mounted in such a manner as to be axially displaceable on the basic body of the swirl generator 4, wherein the restoring force F of a spring attempts to hold the screw channel (portion) S' in a predetermined position. Furthermore, the pressure of the flowing blow-by-gas, which is required for adjusting the screw channel or screw channel portion S', and therefore the desired pressure are fixed by the return spring whose spring force is also optionally adjustable. Alternatively, the adjustment of the screw channel or of the screw channel portion S' can also be achieved in the form of a manually operable slide.

Figure 4:
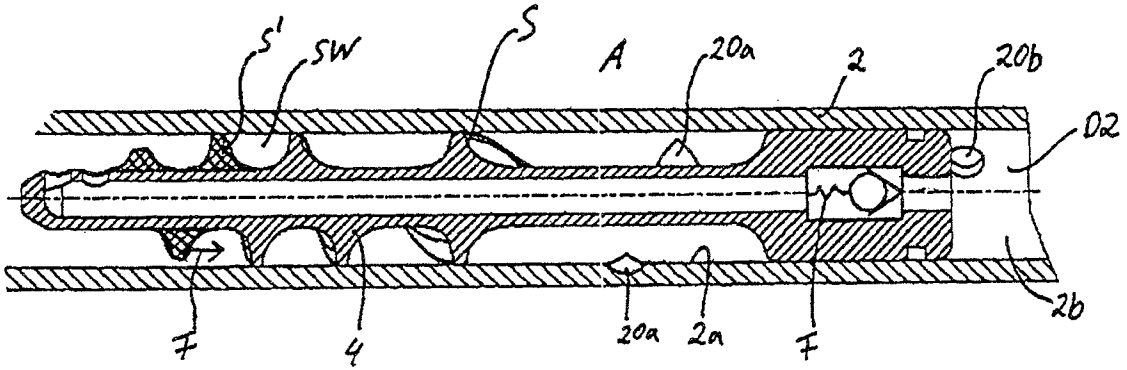
FIG. 4 shows a schematic illustration of sections of the hollow body having an integrated swirl generator which is formed as a helical body and has a displaceably mounted screw channel portion and an integrated bypass channel with a non-return valve.

This solution having an actively changeable flow cross-section by the displacement of the screw channel or screw channel portion S' can be operated both individually in its own right and also in combination with the above-described bypass valve in a bypass channel. This type of development of the invention is schematically illustrated in FIG. 4.

List of Reference Numerals hollow body 2
inner wall (hollow body) 2*a*
cavity (hollow body) 2*b*
first supply opening 20*a*
second supply opening 20*b*
swirl generator 4
bypass channel 4*a*
bypass valve 4*b*
outer/surrounding region (camshaft) A
screw channel S
screw channel/screw channel portion (displaceably mounted) S'
flow channel SW
first pressure region D1
second pressure region D2

The invention claimed is:

1. A hollow body formed at least in regions in a hollow-cylindrical manner, comprising:

a swirl generator disposed in a cavity of the hollow body, at least one first supply opening on a jacket side for introducing gas, which is charged with oil, into the cavity, and at least one discharge opening for carrying away any separated oil and any gas from which oil has been removed, wherein the swirl generator comprises means for variably influencing the pressure prevailing in the cavity at a predetermined location, and wherein the means are formed in such a manner that, when a pressure occurs at the predetermined location that is greater than or equal to a predetermined desired pressure, a reduction of the actual pressure is effected.

2. The hollow body as claimed in claim 1, wherein the swirl generator is formed as a basic body that extends in the axial direction of the hollow body and that comprises, on its periphery, at least one screw channel, and wherein at least regions of the at least one screw channel are mounted so as to be axially displaceable on or at the basic body of the swirl generator.

3. The hollow body as claimed in claim 2, wherein the at least one screw channel is influenced by a restoring force in a direction opposite the flow direction.

4. The hollow body as claimed in claim 1, wherein regions of the swirl generator are formed so that the swirl generator divides the cavity into two pressure regions that can be separated from each other in terms of pressure technology, wherein, in one of the pressure regions, which is located downstream as seen in a flow direction, gas, which is charged with oil can be introduced via the first supply opening into the cavity, wherein, in another of the pressure regions, which is located upstream as seen in the flow direction, gas, which is charged with oil, can be supplied via a second supply opening, and wherein the swirl generator comprises a bypass channel having an integrated pressure-dependent bypass valve.

5. The hollow body as claimed in claim 4, wherein the bypass channel issues into the cavity at an angle between zero and one hundred and ten degrees.

6. The hollow body as claimed in claim 4, wherein the bypass channel issues into the cavity at an angle of approximately ninety degrees.

7. A hollow body formed at least in regions in a hollow-cylindrical manner, comprising:

a swirl generator disposed in a cavity of the hollow body, at least one first supply opening on a jacket side for introducing gas, which is charged with oil, into the cavity, and at least one discharge opening for carrying away any separated oil and any gas from which oil has been removed, wherein the swirl generator comprises means for variably influencing the pressure prevailing in the cavity at a predetermined location, wherein regions of the swirl generator are formed so that the swirl generator divides the cavity into two pressure regions that can be separated from each other in terms of pressure technology, wherein, in one of the pressure regions, which is located downstream as seen in a flow direction, gas, which is charged with oil, can be introduced via the first supply opening into the cavity, wherein, in another of the pressure regions, which is located upstream as seen in the flow direction, gas, which is charged with oil, can be supplied via a second supply opening, and wherein the swirl generator comprises a bypass channel having an integrated pressure-dependent bypass valve.

8. The hollow body as claimed in claim 7, wherein the bypass valve is formed as a non-return valve that is influenced by a restoring force in the direction opposite the flow direction.

9. The hollow body as claimed in claim 7, wherein the bypass channel issues into the cavity at an angle of approximately ninety degrees.

10. The hollow body as claimed in claim 9, wherein the bypass valve is formed as a non-return valve that is influenced by a restoring force in the direction opposite the flow direction.

11. The hollow body as claimed in claim 7, wherein the swirl generator is formed as a basic body that extends in the axial direction of the hollow body and that comprises, on its periphery, at least one screw channel, and wherein at least regions of the at least one screw channel are mounted so as to be axially displaceable on or at the basic body of the swirl generator.

12. The hollow body as claimed in claim 11, wherein the at least one screw channel is influenced by a restoring force in a direction opposite the flow direction.

13. The hollow body as claimed in claim 7, wherein the bypass channel issues into the cavity at an angle between zero and one hundred and ten degrees.

14. The hollow body as claimed in claim 13, wherein the bypass valve is formed as a non-return valve that is influenced by a restoring force in the direction opposite the flow direction.

15. The hollow body as claimed in claim 13, wherein the swirl generator is formed as a basic body that extends in the axial direction of the hollow body and that comprises, on its periphery, at least one screw channel, and wherein at least regions of the at least one screw channel are mounted so as to be axially displaceable on or at the basic body of the swirl generator.

16. The hollow body as claimed in claim 15, wherein the at least one screw channel is influenced by a restoring force in a direction opposite the flow direction.

17. A hollow body formed at least in regions in a hollow-cylindrical manner, comprising:

a swirl generator disposed in a cavity of the hollow body, at least one first supply opening on a jacket side for introducing gas, which is charged with oil, into the cavity, and at least one discharge opening for carrying away any separated oil and any gas from which oil has been removed, wherein the swirl generator comprises means for variably influencing the pressure prevailing in the cavity at a predetermined location, wherein the swirl generator is formed as a basic body that extends in the axial direction of the hollow body and that comprises, on its periphery, at least one screw channel, and wherein at least regions of the at least one screw channel are mounted so as to be axially displaceable on or at the basic body of the swirl generator.

18. The hollow body as claimed in claim 17, wherein the at least one screw channel is influenced by a restoring force in a direction opposite the flow direction.

19. A hollow body formed at least in regions in a hollow-cylindrical manner, comprising:

a swirl generator disposed in a cavity of the hollow body, at least one first supply opening on a jacket side for introducing gas, which is charged with oil, into the cavity, and at least one discharge opening for carrying away any separated oil and any gas from which oil has been removed, wherein the swirl generator comprises means for variably influencing the pressure prevailing in the cavity at a predetermined location, and wherein the hollow body is a hollow camshaft having an integrated oil separating device.

* * * * *